US006131887A

United States Patent [19]

Kühne

[11] Patent Number: 6,131,887

[45] Date of Patent: Oct. 17, 2000

[54] MOUNTING

[75] Inventor: Josef Kühne, Jona, Switzerland

[73] Assignee: Hansa Metallwerke AG, Stuttgart, Germany

[21] Appl. No.: 08/616,516

[22] Filed: Mar. 19, 1996

[30] Foreign Application Priority Data

Mar. 20, 1995 [DE] Germany ..... 195 10 085

[51] Int. Cl.[7] ..... F16B 9/02; A47K 10/10; E03C 1/06

[52] U.S. Cl. ..... 256/65; 256/59; 256/19

[58] Field of Search ..... 256/66, 65, 59, 256/60, 19

[56] References Cited

U.S. PATENT DOCUMENTS

| | | | |
|---|---|---|---|
| 2,886,278 | 5/1959 | Opie | 256/65 X |
| 2,975,558 | 3/1961 | Kokenge | 256/65 X |
| 3,306,641 | 2/1967 | Blum et al. | 256/65 X |
| 3,633,862 | 1/1972 | Breen | 256/65 X |

FOREIGN PATENT DOCUMENTS 43 07 776 7/1994 Germany .

*Primary Examiner*—Anthony Knight
*Attorney, Agent, or Firm*—Lowe, Price, LeBlanc & Becker

[57] ABSTRACT

A mounting (1), which is used to attach one end of a shower rail (2) or similar long object to a wall, consists of an attachment part (3) which can be screwed to the wall. The attachment part (3) has a first toothed portion (8), the teeth of which run parallel to each other perpendicular to the longitudinal direction of the shower rail (2) or at an angle to it. A mounting attachment (12) is connected to the shower rail (2) which as a complementary second toothed portion (13). In the mounted position, this mates with the first toothed portion (8) of the attachment part (3). The mounting attachment (12) is also contained in a holding fixture (16) on a linking part (15) so that it has axial movement, but which is shaped so that the intermeshing of the two sets of teeth (8, 13) can take place. One surface of the linking part (15) which runs perpendicular to the longitudinal direction of the shower rail (2) is supported on a corresponding surface of the attachment part (3). There are also preformed on to the linking part (15) locking elements (17, 20) which, in the mounted position, engage in the corresponding locking devices (17, 18) on the attachment part (3) and, in this way, the two sets of teeth (8, 13) are intermeshed. With the mounting (1) as described, certain dimensional deviations in the distance between the top and bottom attachment part (3) which coincide with the top and bottom mounting (1) can be compensated for without resulting in any unsightly gaps in the area of the mounting (1) or even in any slackness in the fit of the shower rail (2).

13 Claims, 1 Drawing Sheet

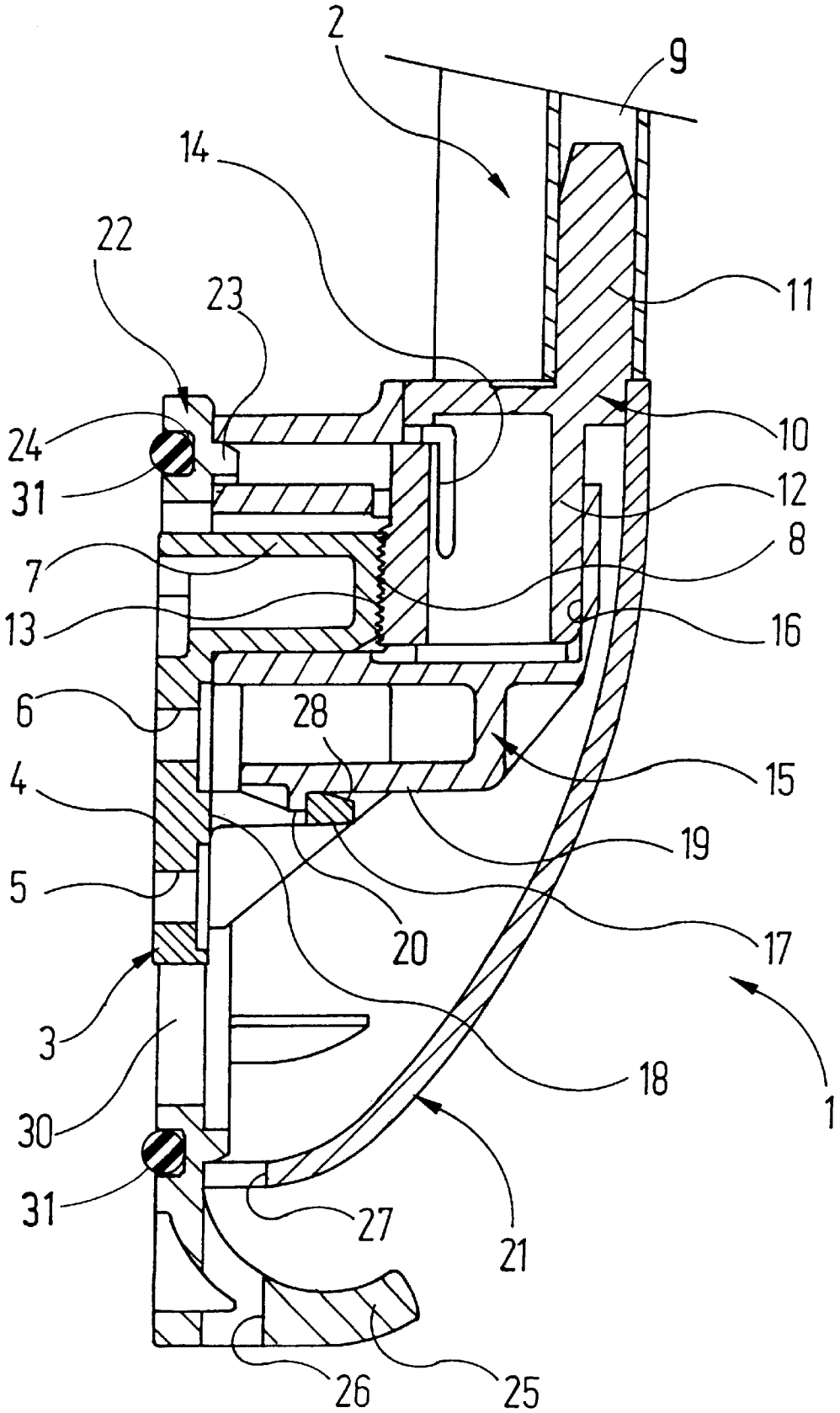
2
9
14
22
23
11
24
10
31
12
7
8
13
16
6
28
15
4
19
5
20
17
3
18
1
30
31
27
21
26
25

MOUNTING

FIELD OF THE INVENTION

The invention concerns a mounting which is used to attach a long object, in particular a shower rail, to two points on a wall which are some distance apart from one another, and more particularly to a mounting that has an attachment part which can be screwed to the wall and which butts thereto via a contact surface and has a holding fixture for the long object which can be pushed on to the attachment part by a movement vertical to the wall and can be secured to it.

BACKGROUND OF THE RELATED ART

A mounting for a sanitary drier is described in DE 43 07 776 C which has the features named at the beginning and which is also basically suitable for use as a mounting for a shower rail. In this design, the so-called "functional part", when applied to a shower rail mounting and therefore the shower rail, is inserted into a cylindrical recess in the holding fixture and is supported axially in this due to the face contact in one direction. If, for example due to a drilling error, the two attachment parts required to fix a shower rail are not exactly the right distance apart to allow the shower rail to butt against the faces of the two ends, the shower rail then experiences axial play. This is undesirable because this type of looseness creates a feeling of insecurity for the user of the shower.

Similar problems also arise with the more simple types of known shower rail mountings in which the holding fixture for the shower rail is screwed directly on to the wall.

SUMMARY OF THE INVENTION

A principal object of this invention is to provide a mounting of the type described at the beginning, such that certain deviations in the actual mounting position of the attachment parts can be compensated by an ideal position corresponding to the dimensions of the long object.

This problem is solved according to the invention in that c) the attachment part has a first toothed portion, the teeth of which run parallel to each other and perpendicular or at an angle to the longitudinal direction of the long object;

d) there is connected to the end of the long object a mounting attachment which has a second toothed portion corresponding to the first toothed portion on the attachment part;

e) a linking part is provided which
   - ea) has a holding fixture which holds the mounting attachment so that it has axial movement;
   - eb) has a fixture by means of which the linking part is moved in the direction of the attachment part and can be secured to it, whereby f) in an end position of the fixture the first toothed portion of the attachment part and the second toothed portion of the mounting attachment intermesh.

DETAILED DESCRIPTION OF THE PREFERRED EMBODIMENTS

The solution to the problem described above according to the invention is therefore to be found in the interaction of three main components: the toothed mounting attachment which is connected to the end of the long object, for example the shower rail, the attachment part which is used to actually fix the mounting to the wall and which also has a correspondingly toothed portion, and the linking parts with which the mounting attachment can be secured to the attachment part so that the teeth on the two parts intermesh in a manner appropriate to the actual length of the long object. In a mounting according to the invention, the teeth on the mounting attachment "seek out" the correct relative position to the teeth on the attachment part without this requiring any time-consuming adjustment operations.

It is an easy matter for the linking part to find its correct position on the attachment part if it has a surface which runs perpendicular to the longitudinal direction of the long object and butts against one surface of the attachment part in the mounted position.

The linking part can be attached and secured without any tools if its fixtures take the form of locking devices which act in combination with locking devices on the attachment part. The locking devices themselves do not therefore need to the accessible and can therefore be concealed, under a transparent housing for example.

It is expedient if the toothed portion of the attachment part has a projection on the attachment part which faces away from the contact surface. In this way, the distance which is usually required between the long item and the wall is obtained.

The presence of this projection can also be used to butt the linking part in the mounted position against a surface of the projection on the attachment part which runs perpendicular to the contact surface. Similarly, the projection on the attachment part therefore at the same time helps to position the linking part, this position remaining the same within the adjustable range for all the different lengths of the shower rail.

In a preferred embodiment of the invention, the locking devices on the attachment part consist of a locking projection facing away from the contact surface and a locking recess which is provided in this and the locking devices of the linking part consist of a flexible cover plate preformed on to the linking part and a locking lug which is preformed on to the cover plate and which, in the mounted position, engages in the locking recess.

To achieve this, the preferred embodiment is again one in which an inclined cam surface is provided on the locking projection of the attachment part which the locking lug of the linking part slides along when the linking part is pushed on to the attachment part. In this configuration of the invention, when the linking part is pushed on to the attachment part, the mounting attachment first of all seeks its correct axial position inside the holding fixture of the linking part before the teeth on the attachment part and on the mounting attachment mate in the last phase of assembly when the locking devices intermesh. Only then is the position of the three parts relative to each other fixed.

It is expedient if the mounting attachment takes the form of a clamping piece which has a clamping attachment which can be inserted force fit into the interior of the long object. Shower rails and suchlike generally take the form of hollow bars; they can be cut to length as required. To attach the parts obtained in this way, there is fitted into each of the two ends a clamping piece which can then be secured to the wall using the mounting attachment fitted to this and with the aid of a wall mounting according to the invention.

In a particularly preferred embodiment of the invention, the clamping piece also has another role: in the in-between area between the clamping attachment and the mounting attachment a transparent housing can be mounted on to the clamping piece which, in the mounted position, conceals the attachment part, the linking part and the mounting attachment. The relative position between the transparent housing and the attachment part is therefore not fixed at the beginning but changes in line with the exact length of the shower rail just as the relative position of the mounting attachment can change relative to the attachment part. In this configuration according to the invention there are never any unsightly gaps between the transparent housing and the shower rail.

It is a simple process to mount the transparent housing on to the clamping piece and to secure it to it if the mounting attachment has an elastically sprung area outside the toothed portion.

A spacer can be fitted on the free edge of the transparent housing to ensure that there is a visually pleasing appearance where it meets the wall. Several of these spacers can also be placed one on top of the other to compensate for any unevenness in the wall which may, for example, exist between the top and the bottom shower rail mountings.

The spacer is easy to fit in that it is mounted on the attachment part in such a way that it is capable of movement.

On the side facing the wall, the spacer can carry a seal, especially an O-ring. This prevents water from getting into the space surrounded by the transparent housing.

One embodiment of the invention is explained in greater detail below with the aid of the drawing; the single FIGURE shows a vertical section through a shower rail mounting with part of the shower rail mounted on it.

The FIGURE shows the bottom area of a shower rail which altogether has the reference number 2. In the embodiment shown, this is a hollow shaped part which is non-circular in cross-section for reasons which are of no consequence here. The shower rail 2 is attached to the wall of the shower cubicle or to the bathroom wall by means of a shower rail mounting 1; a similar shower rail mounting 1 is to be imagined at the top end of the shower rail 2.

The shower rail mounting 1 consists of an attachment part 3, the contact surface 4 of which butts on to the wall. The attachment part 3 has holes 5, 6 through it, through which go fixing screws (not illustrated) which are screwed into the plug sunk into the wall.

There is preformed on to the attachment part 3 a cuboid projection 7 which, for manufacturing reasons, is hollow and which has a toothed portion 8 on the front face which runs parallel to the contact surface 4. The individual teeth of the toothed portion 8 run parallel to each other and vertical to the drawing plane.

A similarly shaped clamping attachment 11 on a clamping piece 10 is pressed into the inner chamber 9 of the shower rail 2. A hollow mounting attachment 12 which opens downwards is preformed on to the clamping piece 10 parallel to the clamping attachment 11. A toothed portion is also provided on the mounting attachment 12 which is complementary to the toothed portion 8 on the attachment part 7 and, in the fully assembled condition as shown in the drawing, meshes in this in a specific relative position. By virtue of a U-shaped slot 14 which is made in the mounting attachment 12 of the clamping piece 10, the area of the mounting attachment which lies outside the toothed portion 13 takes on the character of a spring cover plate which can be pressed flexibly inwards to a certain extent.

The mounting attachment 12 on the clamping piece 10 is introduced into a holding fixture 16 in a linking part 15. The linking part 15 is a moulded part, the upwards facing surface of which as shown in the drawing butts against the adjoining downwards facing surface of the projection 7 on the attachment part 3.

The attachment part 3 has a locking projection 17 with a locking opening 18. The locking lug 20 on a flexible cover plate 19 preformed on to the linking part 15 meshes into the locking opening 18 in the finish mounted condition shown in the drawing.

In the area where the clamping attachment 11 joins the mounting attachment 12, a transparent housing 21 is fitted on to the clamping part 10 which hides the parts inside from the eye of the beholder. The transparent housing 21 is open to the wall where it is mounted force fit on to a circular rib 23 on a spacer 22. The side of the spacer 22 facing the wall has a circular groove 24 in it into which an O-ring seal 31 can be inserted (not shown).

A hook 25 is preformed in one piece on to the spacer 22 and can, for example, be used to hang a flannel or suchlike. This hook 25 can also be dispensed with in the top shower rail mounting 1 which is not shown in the drawing.

Holes 26, 27 are made through the spacer 22 (in the area of the hook 25) and through the aligned area of the transparent housing, the purpose of which will be described later on.

The shower rail mounting 1 operates as follows:

First of all an attachment part 3 is screwed on to the wall in the mounting zone of both the top and bottom end of the shower rail 2. To do this, the holes are marked on the wall using the appropriate drilling templates; they are then drilled and plugs inserted. The attachment parts 3 are then secured to the wall using screws which go through the holes 5, 6. The vertical distance between the two attachment parts 3 is roughly adhered to, according to the length of the shower rail 2. In view of the fact that allowance always has to be made for a certain amount of inaccuracy when making the holes in the wall, tolerances in the region of a few millimeters can be compensated for by the two shower rail mountings 1. How this is achieved with the shower rail mountings described will be made clear in the following explanation.

Let us first of all assume that the top shower rail mounting 1 which is not shown in the drawing is already at least loosely mounted on the wall. This gives the position of the bottom end of the shower rail 2 which, as has been stated above, does not always correspond to the correct position relative to the attachment part 3. The clamping attachment 11 of the clamping piece 10 is already inserted into the bottom end of the shower rail 2. The transparent housing 21 is positioned at a slight inclined position to the wall, at about 15° relative to the vertical, and is then slipped over the mounting attachment 12 whereby the flexible area at the end of the mounting attachment 12 caused by the slot 14 is pushed inwards just before the end position of the transparent housing 21 is reached and springs out again when the end position of the transparent housing 21 is reached and in this way secures the transparent housing 21. The linking part 15 is finally slipped over the mounting attachment 12. In this state there is still some relative axial movement possible between the linking part 15 and the clamping piece 10.

The spacer 22, which has complementary guide surfaces 30 at its internal contour, is fitted on to the attachment part 3 which has parallel vertical guide surfaces. Owing to the slight force fit between the guide surfaces of attachment part 3 and spacer 22 a roughly vertical alignment and preliminary fixing of the spacer 22 is possible.

The complete structural unit which this forms, that is to say the bottom end of the shower rail 2, the clamping piece 10 secured in it, the linking part 15 and the transparent housing 21 is now offered up to the wall, and therefore it is for example pivoted about the top, loosely attached mounting point. With this movement the locking lug 20 slides over an inclined cam surface 28 on the locking projection 17 on the attachment part 3. By so doing the linking part 15 is pushed upwards as shown in the drawing until the above-mentioned surface of the linking part 15 comes up against the projection 7 on the attachment part 3. The linking part 15 has now found its correct axial position vis-a-vis the clamping piece 10. As the movement of the structural unit which is connected to the bottom end of the shower rail 2 progresses the locking lug 20 finally reaches the area of the locking opening 18 in the locking projection 17 on the attachment part 3. The locking lug 20 springs into the locking opening 18, as a result of which both the linking part 15 and also the clamping part 10 are secured to the attachment part 3. In this position the complementary toothed portion 8 of the attachment part 13 and that of the clamping piece 10 intermesh, with the result that axial relative movement between the attachment part 3 and the clamping piece 10 is no longer possible. As the structural unit is offered up to the wall as described above, the pre-fitted spacer 22 is simultaneously pushed into its final position and secured by slipping it over the inside edge of the transparent housing 21. The bottom end of the shower rail 2 is now secured to the wall of the shower cubicle or the bathroom by means of the attachment part 3.

If the shower rail mounting 1 is required to be removed, then a tool, for example a screwdriver, is inserted through the holes 26 and 27 going through the spacer 22 and the transparent housing 21 and the locking lug 20 on the cover plate 19 on the linking part 15 is removed from the locking opening 18 in the attachment part 3. The bottom end of the shower rail 2 and the structural unit made up of the clamping piece 10, linking part 15 and transparent housing 21 which is connected to it can then again be moved away from the wall.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A mounting system including a pair of cooperating mountings for attaching a long object to two points on a wall some distance apart from each other, each mounting comprising:

a) an attachment part which can be screwed to the wall and butts against the wall via a contact surface;

b) a holding fixture for the long object, which can be pushed on to the attachment part by a movement vertical to the wall to be attached thereto, wherein the attachment part has a first toothed portion having teeth which run parallel to each other and vertical or at an angle to a longitudinal direction of the long object, wherein there is connected to the end of the long object a mounting attachment which has a second toothed portion which is formed to be complementary to the first toothed portion; and c) linking part supported to the attachment part, which has a holding fixture which receives the mounting attachment in a manner allowing axial movement, and has additional fixtures with which the linking part can be moved towards the attachment part to be secured thereto, whereby the first toothed portion and the second toothed portion mesh with one another in an end position of the additional fixtures.

2. The mounting system according to claim 1, wherein:

the linking part has a surface which runs perpendicular to the longitudinal direction of the long object and in mounted position butts against a surface of the attachment part.

3. The mounting system according to claim 1, wherein:

the fixtures for linking part consist of locking elements which act in combination with cooperating locking devices on the attachment part.

4. The mounting system according to claim 3, wherein:

the locking devices on the attachment part consist of a locking projection which points away from the contact surface and a locking recess provided in the projection, the locking devices on the linking part comprising a flexible cover plate preformed on to the linking part and a locking lug performed on to the cover and in the mounted position engaged in the locking recess.

5. The mounting system according to claim 4, wherein:

an inclined cam surface is provided on the locking projection on the attachment part, along which the locking lug on the linking part slides when the linking part is pushed on to the attachment part.

6. The mounting system according to claim 1, wherein:

the first toothed portion is provided on a projection of the attachment part which points away from the contact surface.

7. The mounting according to claim 6, wherein:

in a mounted position, the linking part butts against a surface of the projection on the attachment part which is oriented perpendicular to the contact surface.

8. The mounting system according to claim 1, wherein:

the mounting attachment is formed on a clamping piece which has a clamping attachment which can be introduced force fit into an inner chamber of the long object.

9. The mounting system according to claim 8, wherein:

there is pushed onto the clamping piece, in an area where the clamping attachment joins the mounting attachment, a transparent housing which, in the mounted position, covers the attachment part, the linking part and the mounting attachment.

10. The mounting system according to claim 9, wherein:

a spacer is fitted on the free edge of the transparent housing.

11. The mounting system according to claim 10, wherein:

the spacer is mounted on the attachment part so that it is capable of movement.

12. The mounting system according to claim 8, wherein:

the mounting attachment has a flexibly sprung area out side the second toothed portion.

13. The mounting system according to claim 9, wherein:

a side of the spacer which faces the wall is provided with a seal.

* * * * *